US006071466A

United States Patent [19]

Cates et al.

[11] Patent Number: 6,071,466

[45] **Date of Patent: *Jun. 6, 2000**

[54] SUBMERGIBLE PROBE FOR VIEWING AND ANALYZING PROPERTIES OF A MOLTEN METAL BATH

[75] Inventors: Larry E. Cates, Pittsburgh; Paul Reich, Rochester, both of Pa.

[73] Assignee: Voest Alpine Industries, Inc., Pittsburgh, Pa.

[ * ] Notice: This patent is subject to a terminal disclaimer.

[21] Appl. No.: 09/133,597

[22] Filed: Aug. 13, 1998

Related U.S. Application Data

[63] Continuation-in-part of application No. 08/733,626, Oct. 17, 1996, Pat. No. 5,830,407.

[51] Int. Cl.[7] ..... C21B 7/24

[52] U.S. Cl. ..... 266/44; 266/100

[58] Field of Search ..... 266/44, 100, 270, 266/265

[56] References Cited

U.S. PATENT DOCUMENTS

| | | |
|---|---|---|
| 3,188,070 | 6/1965 | Lee . |
| 3,652,068 | 3/1972 | Truppe et al. . |
| 4,106,756 | 8/1978 | Rymarchyk et al. . |
| 4,377,347 | 3/1983 | Hanmyo et al. . |
| 4,411,533 | 10/1983 | Loftus et al. . |
| 4,416,443 | 11/1983 | Helfi et al. . |
| 4,468,009 | 8/1984 | Clauss et al. . |
| 4,651,976 | 3/1987 | Arima et al. . |
| 4,741,515 | 5/1988 | Sharma et al. . |
| 4,842,253 | 6/1989 | Takeda et al. . |
| 4,898,368 | 2/1990 | Schaffer et al. . |
| 5,071,105 | 12/1991 | Donze et al. . |
| 5,234,200 | 8/1993 | Pirklbauer et al. . |
| 5,397,108 | 3/1995 | Alexander et al. . |
| 5,830,407 | 11/1998 | Cates ..... 266/44 |

OTHER PUBLICATIONS

"How Berry Metals Helps Improve BOF Operations", *Industry Net Report*, Sep. 1996, and "Sensing Temperatures During Steelmaking," *33 Metal Producing*, Sep. 1996, p. 30.

"Direct Analysis in Steelmaking Converters Using Laser–Induced Emission Spectrometry," Krupp Forschungsinstitut, Essen Germany. Dec. 1996.

*Primary Examiner*—Scott Kastler

*Attorney, Agent, or Firm*—Armstrong, Westerman, Hattori, McLeland & Naughton

[57] ABSTRACT

An apparatus and method for viewing and analyzing the interior of a molten metal bath during treatment in a metallurgical vessel comprises a concentric pipe tuyere extending into an open mouth of the vessel and below the surface of the bath and comprising an inner pipe through which a pressurized transparent fluid is passed, and an outer pipe forming, with the inner pipe, an annulus through which a cooling fluid is passed. A sight glass is disposed in alignment with an opening in the inner pipe and with a centerline of the tuyere providing visual access to the interior of the bath. An optical sensor is associated with the sight glass to receive and analyze light generated in the bath to determine molten metal properties such as temperature and chemical composition.

15 Claims, 4 Drawing Sheets

SUBMERGIBLE PROBE FOR VIEWING AND ANALYZING PROPERTIES OF A MOLTEN METAL BATH

RELATED APPLICATION

This application is a continuation-in-part of application Ser. No. 08/733,626, filed Oct. 17, 1996, now U.S. Pat. No. 5,830,407.

BACKGROUND OF THE INVENTION

1. Field of the Invention

This invention relates to a pressurized port for viewing the interior of a molten metal bath contained in a treatment vessel and, with use of an optical sensor, for measuring the temperature, composition, or other properties of the molten metal bath.

2. Description of the Prior Art

In the production and/or treatment of metals in a molten metal bath, it is necessary to determine the temperature, composition or other properties of the molten metal bath. Such processes do not allow direct inspection because the molten metal is contained in a refractory lined furnace and, in such production processes, a layer of slag floats on top of the metal during processing. In order to determine the temperature and chemical composition of the metal, devices are inserted through the slag into the metal. The high temperatures involved do not permit the use of materials other than refractories to come in contact with the molten metal for any extended period of time.

In the past, the method for determining temperature of such molten metal baths has required inserting an expendable thermocouple into the bath, in which case the thermocouple is used for only one test, then discarded or destroyed. The method of analyzing the chemical composition of the bath is to withdraw a sample of the metal and send it to a laboratory for analysis. Insertion of such devices, and the withdrawing of samples, requires that the production process be stopped, thus delaying the process. Further time delays occur while the samples are transported and analyzed. Since direct inspection cannot be done, predictive calculations must be made to determine the amount of reactive materials required to reach the desired temperature and composition.

Various attempts have been made to avoid such indirect methods of analyzing molten metal baths.

For example, U.S. Pat. No. 4,106,756 discloses an oxygen lance and sensor system consisting of an optical sensor mounted on an oxygen lance suspended above the molten metal bath for monitoring the furnace and bath. The view thus provided is of the upper surface of the bath consisting of a highly agitated and heated mixture of metal and slag due to oxygen blowing onto the surface of the bath.

U.S. Pat. No. 4,377,347 relates to use of a probe, comprising a thermocouple covered with ceramic fiber, inserted through a vessel wall and immersed in the molten metal bath, and generating a signal proportional to bath temperature which is sent to an external pyrometer; it typically is used in a continuous caster tundish. There is no direct viewing of the bath.

U.S. Pat. No. 4,416,443 discloses a thermocouple attached to a concentric pipe tuyere extending through the bottom of a furnace wherein the thermocouple is used to warn of high tuyere temperatures indicating tuyere blockage.

U.S. Pat. No. 4,651,976 shows a furnace having a side opening, above the surface of the metal bath in the furnace, in which opening there is disposed an optical device, such as a photometer, to view the light level above the bath for determining the amount of slag being formed. There is no direct viewing of the bath.

U.S. Pat. No. 4,842,253 relates to an optical device mounted in a port in the side of a blast furnace or the like and with its field of view arranged to include the combustion zone of an adjacent tuyere in order to monitor combustion conditions in the furnace.

U.S. Pat. No. 5,071,105 discloses a gas torch having an optical lens and fiber assembly fitted into the torch to provide visual observation of the high temperature process resulting from operation of the torch.

U.S. Pat. No. 5,397,108 discloses a peepsight for a blast furnace tuyere system, in which a fiber optic cable is disposed opposite a viewing port of a sleeve extending into the furnace wall and carries a light signal to a photosensitive sensor.

Industry Net publication of September 1996 discloses an oxygen lance for a top-blown oxygen furnace, in which a pyrometer is mounted inside the lance to measure the temperature of the hot spot of metal and slag where the oxygen jet impinges on the surface of the bath.

A recent paper entitled "Direct Analysis in Steelmaking Converters Using Laser-Induced Emission Spectrometry," C. Carlhoff and S. Kirchhoff, Krupp Forschungsinstitut, Essen, Germany, discloses the use of a laser beam directed, through an opening in the side of the furnace, onto the bath surface, producing a hot plasma, and the generated light is carried by a fiber optic cable to a spectrometer.

SUMMARY OF THE INVENTION

This invention provides a concentric pipe tuyere extending, preferably, vertically through the bottom, or alternatively, through an open mouth in the top, of a metallurgical treatment vessel, such as a steelmaking furnace, containing a molten metal bath, wherein the center pipe carries a transparent gas under pressure to maintain an opening into the metal bath. Such gas flow has a sufficiently high ferrostatic head to prevent liquid metal from entering the tuyere. Typical gases include oxygen, nitrogen, carbon dioxide and argon. A reactive gas, such as oxygen, preferably is used during at least a part of the process to produce sufficient heat to melt frozen metal and slag formations about the mouth of the tuyere to keep the passage into the molten metal open.

A coolant is passed through the annulus between the inner and outer pipes, and may consist of a liquid or gas capable of carrying away the heat developed during the process. Typical coolants are nitrogen, carbon dioxide, argon and methane or natural gas.

A viewing port is provided and sealed with a sight glass capable of withstanding the pressures and temperatures involved, while allowing light to pass through.

Various sensors, such as a camera, pyrometer, spectrometer, or other optical devices, may be mounted to the sight glass in order to view and analyze the molten metal inside the furnace.

In an alternative embodiment, the invention comprises a similar viewing and measuring device suspended above and lowerable into a molten metal bath and wherein an extension of the concentric tube tuyere is submersible in the molten metal and is encased within an insulating ceramic or other refractory material to protect the tuyere from the heat of the molten metal bath when so submerged.

DESCRIPTION OF PREFERRED EMBODIMENTS

Figure 1:
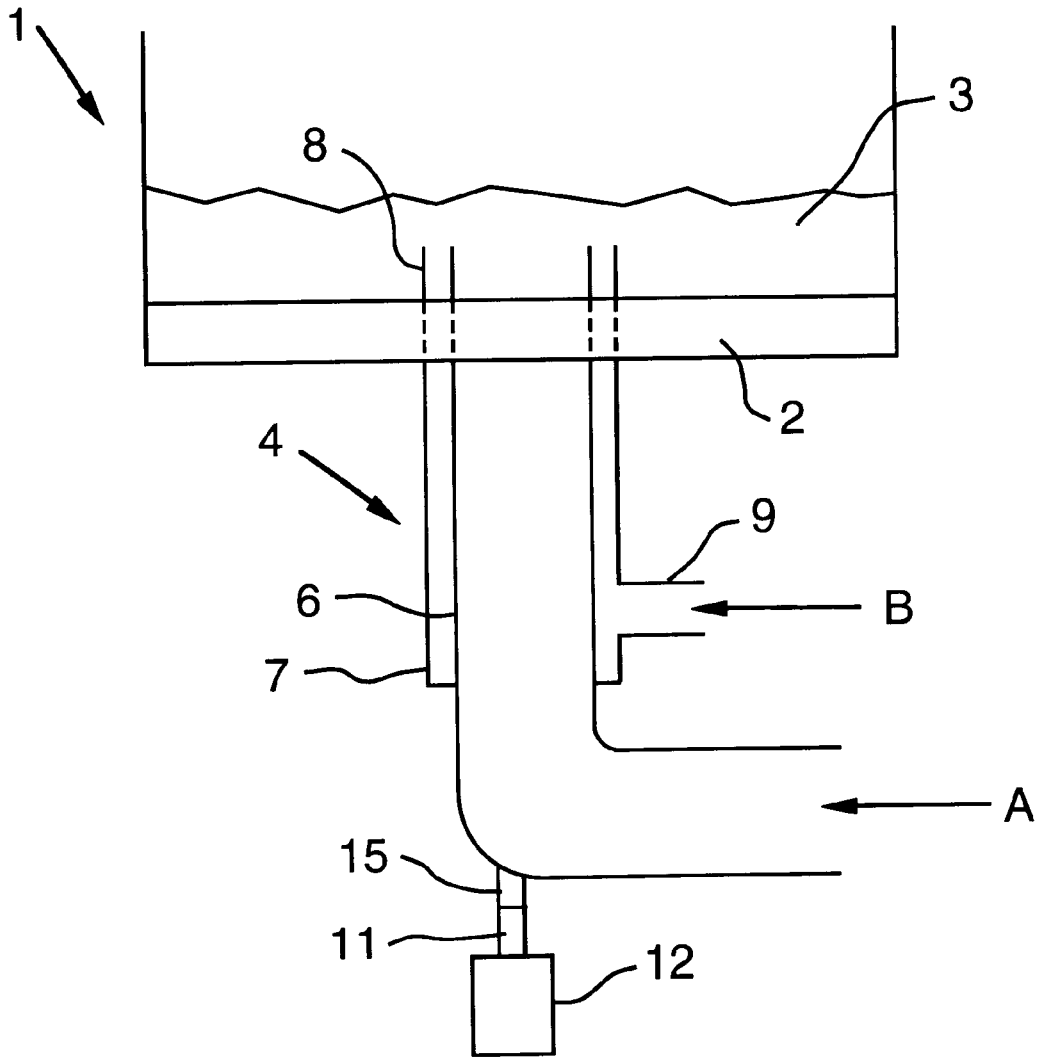
FIG. 1 is a schematic side elevation of the apparatus of the invention.

In FIG. 1, the numeral 1 generally denotes a metallurgical furnace, such as a steelmaking furnace, having a refractory-lined bottom 2, and containing a molten metal bath 3. A concentric pipe tuyere, denoted generally by the numeral 4, comprises an inner pipe 6 and an outer pipe 7. A tip 8 of the tuyere 4 extends above the surface of the furnace bottom 2 and into the molten metal bath. A transparent gas, such as oxygen, nitrogen, carbon dioxide or argon, is passed through the inner pipe 6, as at "A" in FIG. 1, and a coolant, such a nitrogen, carbon dioxide, argon or methane, is passed through a connection fitting 9 into the annulus between the inner pipe 6 and the outer pipe 7, as in the direction "B" as shown in FIG. 1.

A sight glass assembly 11 is connected, through an extension 5, to the inner pipe 6, allowing a direct view, through the assembly 11, extension pipe 5 and inner pipe 6, into the interior of the molten metal bath above the tip or mouth 8 of the tuyere 4. A photometer, for measuring temperature of the bath, or other optical sensing device, such as a spectrometer for determining metal bath composition or a camera, such device being denoted by the numeral 12, is connected to the sight glass assembly 11.

Figure 2:
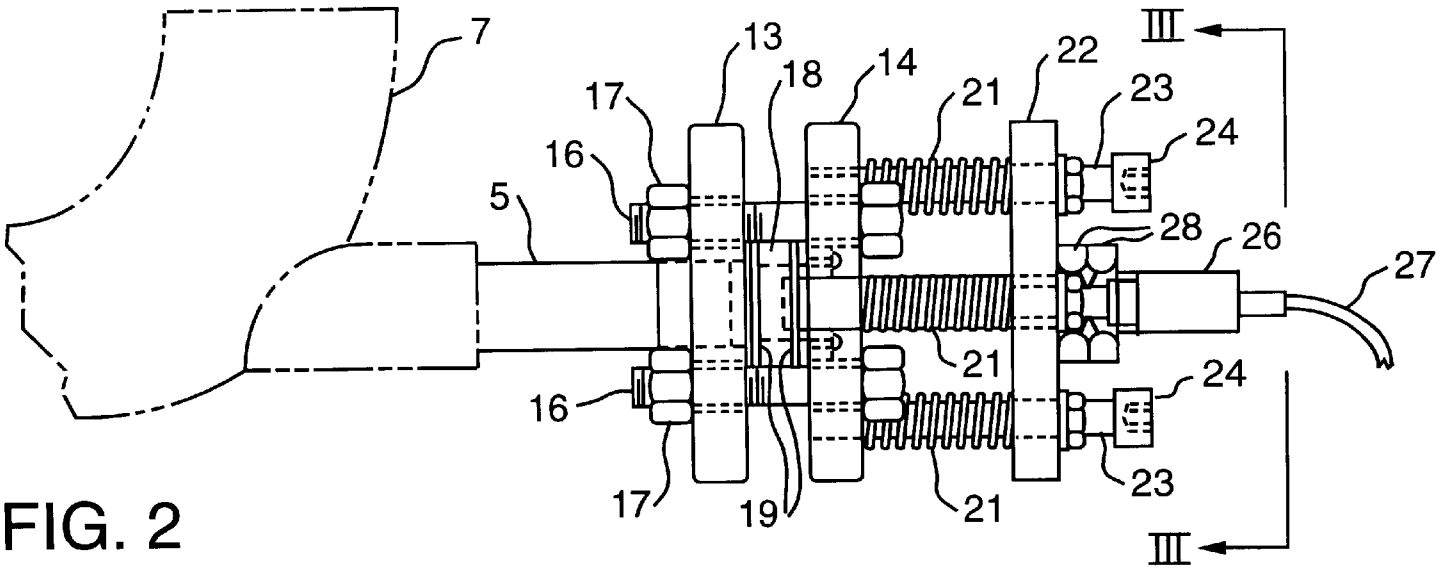
FIG. 2 is a side elevational view of a means for mounting the sight glass and fiber optic assembly to the tuyere.
Figure 3:
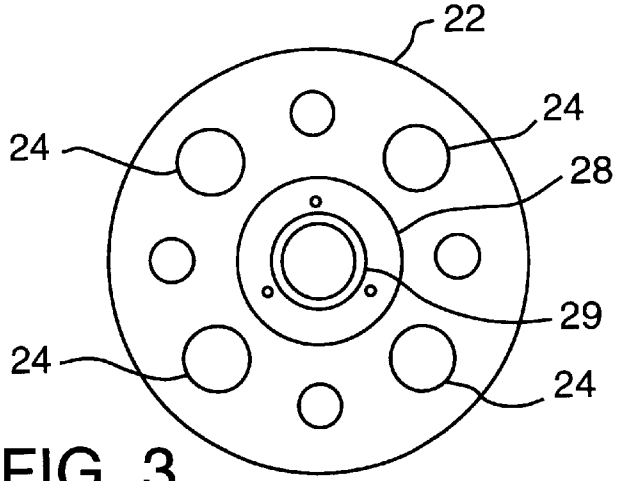
FIG. 3 is an end view of the assembly of FIG. 2 taken along line III—III of FIG. 2.
Figure 4A:
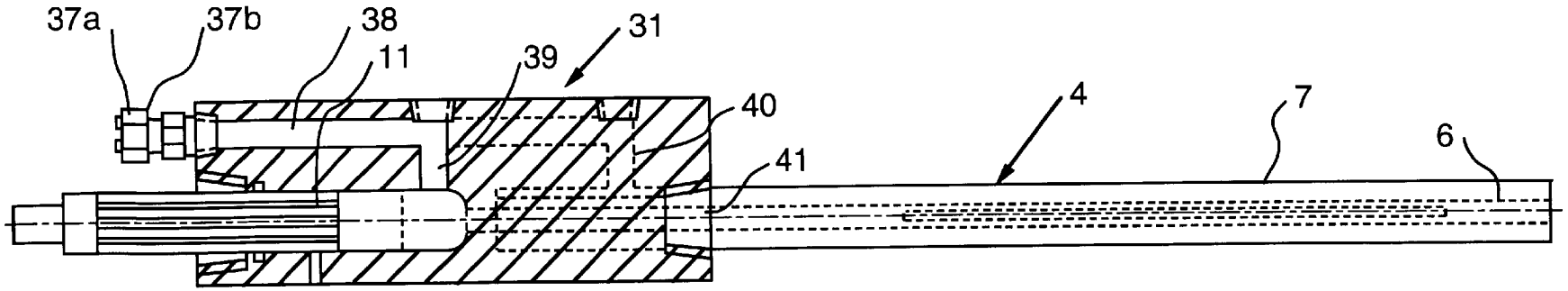
FIG. 4A is a side elevation, partly in cross-section, of the concentric tubes and optical lens assembly of an alternative embodiment of the invention.
Figure 4B:
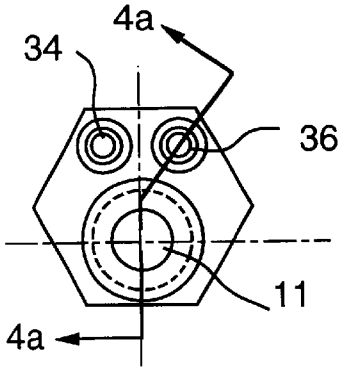
FIG. 4B is an elevational view of a first end of the device of FIG. 4A.
Figure 4C:
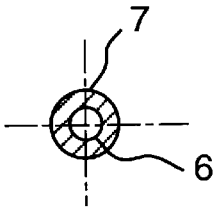
FIG. 4C is an elevational view of a second end of the device of FIG. 4A.
Figure 5A:
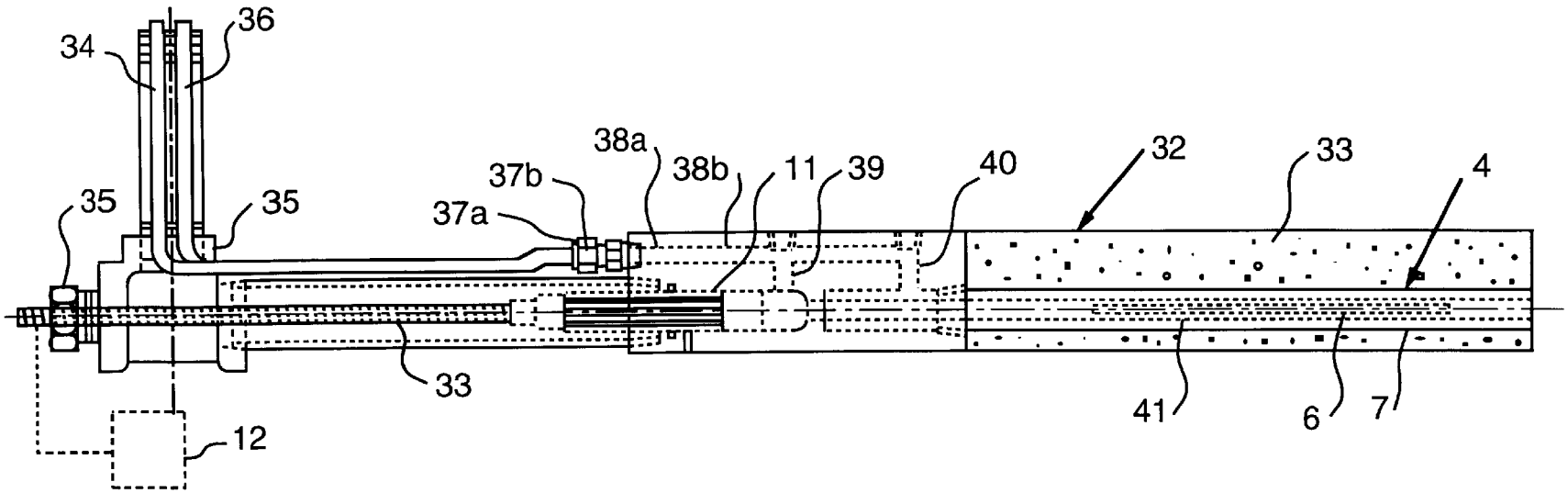
FIG. 5A is a side elevation of the alternative device of the invention, encased in refractory and showing sources of pressurizing and cooling fluids.
Figure 5B:
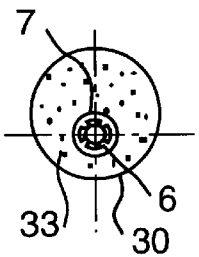
FIG. 5B is an elevational view of the second end of the device of FIG. 5A.

Details of one embodiment of means to mount the sight glass and optical sensor are shown in FIGS. 2 and 3. A lens alignment plate 13 is mounted on extension pipe 5 and is secured thereto and to a first mounting plate 14 by four hex cap screws 16 and nuts 17. A glass window or lens 18, with gaskets 19, is compressed between plates 13 and 14 by tightening screws 16 and nuts 17. To reduce unwanted movement of the assembly, as by vibration, four compression springs 21 are disposed and compressed between the first mounting plate 14 and a second mounting plate 22 by means of four cap screws 23 and jam nuts 24. Each of the plates 13, 14 and 22 are centrally apertured, as best shown in FIG. 3, being an end view of the mounting assembly of FIG. 2, providing an unobstructed view, through the assembly and into extension pipe 5 and inner pipe 6, for the end structure 26 of a fiber optic cable 27 mounted, by means of rings 28 to the central aperture 29 of the second mounting plate 22.

In operation, a transparent gas such as a liquid or a gas such as oxygen, nitrogen, carbon dioxide or argon, is passed through the inner pipe 6 and a cooling medium, such as nitrogen, carbon dioxide, argon, or methane, is passed through the annulus between the inner pipe and the outer pipe 7. As noted, in order to keep the tip 8 of the tuyere 4 clear of frozen metal and slag, it normally is required that the gas passed through inner pipe 6 comprise oxygen at least in part. Thereby there is provided a direct view into the interior of the molten metal bath so that metal parameters such as temperature or composition can be obtained free of distortions caused by the presence of slag.

The inner and outer pipes of the tuyere 4 may be spaced apart by fluting or other projections on the outer surface of the inner pipe 6 or on the inner surface of the outer pipe 7, in known manner.

Such use of the invention can have additional advantages. The Q-BOP furnace and process uses multiple, relatively large diameter, double pipe tuyeres with oxygen in the center pipe and a coolant, such as methane (natural gas), in the annulus between the inner and outer pipes. Such tuyeres, although forming "mushrooms" of frozen metal about the peripheries of the mouths of the tuyeres, seldom become clogged with frozen metal or slag. On the other hand, many top-blown basic oxygen furnaces today utilize bottom gas stirring with porous blocks or "micro-tuyeres" comprising small diameter metal, e.g. copper, pipes through which a stirring gas is emitted into the molten metal bath. Also today, there is commonly used a practice of slag washing the interior refractories of the furnace with molten slag remaining after a heat of steel is finished. While this practice is effective to prolong the life of the refractory lining of the furnace, slag washing tends to freeze and cover over bottom stirring porous blocks or micro-tuyeres, so that, after a relatively few heats with bottom stirring, such devices become blocked and stirring cannot be maintained. The relatively large diameter tuyere of this invention, when used with oxygen or other suitable gas flow in the center pipe, can also serve to bottom stir the molten metal bath and is not as susceptible to blockage by slag washing as are porous blocks and micro-tuyeres, and thus may replace the latter while also serving the described viewing and analytical purposes.

If desired, the apparatus of the invention, as above described, may be mounted in the side of the metallurgical vessel below the surface of the molten metal contained therein. In such case, however, the additional advantages of the invention, as above described, are not achieved or are of decreased effect.

Moreover, in another embodiment of the invention the viewing and measuring probe may be suspended above the mouth of a furnace or other metallurgical vessel, and is adapted for lowering into a molten metal bath contained in the vessel. Thus, as shown in FIGS. 4A–4C and 5A and 5B, the concentric inner pipe 6 and outer pipe 7, comprising tuyere 4, may be mounted in a housing denoted generally by the numeral 31, and have an extension, generally denoted by the numeral 32, covered by an insulative refractory 33 and a stainless steel sheath 30, and adapted for immersion into a molten metal bath. The sight glass lens assembly 11 is mounted in the housing 31 and is connected, as by a fiber optic cable or light guide 33 extending through a direct sight viewing port connection 35 and thence to a remotely disposed measuring device 12 which, above described, may comprise a pyrometer for measuring bath temperature and a spectrometer for determining chemical composition of the bath. As in the previously described embodiment, a transparent gas, such as oxygen, nitrogen or argon, is passed through the inner pipe 6, as through a supply pipe 34 extending through an elbow connection 35, and thence through a connection 37*a* to a passage 38*a* and a passage 39 in the housing 31 to the interior of pipe 6 and at sufficient pressure to maintain an opening into the metal bath. A reactive gas such as oxygen is used during at least a part of the process to produce heat in order to melt frozen slag and metal formations and to keep the passage open. As before, a coolant fluid is passed through the outer pipe 7, as from a supply pipe 36, through a connection 37*b*, to passages 38*b* and 40 in the housing 31 and, through passage 40, in communication with an annular space 41 between inner pipe 6 and outer pipe 7.

Such alternative embodiment of the invention may be suspended above a metal bath the properties of which are to be analyzed and the extension portion 32 of the probe then lowered through overlying slag and into the bath for accurate measurement. It is particularly useful with a ladle furnace or a continuous caster tundish which permit ready access to the surface of a metal bath contained therein, but which do not easily permit the installation of subsurface ports through the refractory lining.

The apparatus of this invention thus is useful with both bottom blown and top blown oxygen furnaces, particularly in the refining of steel to remove carbon by combustion with oxygen, as well as with other metallurgical treatment vessels and processes, such as argon/oxygen decarburization ("AOD" ), ladle refining, etc.

Use of this invention avoids the delays inherent in prior art practices in the treatment of molten metals using expendable thermocouples to measure bath temperature and withdrawing of samples of molten metal for chemical analysis, and thus contributes significantly to the economy of such processes.

What is claimed is:

1. An apparatus for viewing and analyzing the interior of a bath of molten metal during treatment thereof in a refractory-lined metallurgical treatment vessel having side walls, bottom and an open mouth at the top of the vessel, comprising a concentric double-pipe tuyere comprising an inner pipe for passage of a pressurized transparent fluid and an outer pipe surrounding the inner pipe and defining an elongated cylindrical annulus between the pipes for passage of a pressurized cooling fluid, an insulative refractory surrounding a lower portion of the tuyere, means for mounting the tuyere above the mouth of the vessel and vertically movably to position said lower portion of the tuyere into a molten metal bath contained in the vessel, means for pressurizing and passing the transparent fluid through the inner pipe, means for pressurizing and passing the cooling fluid through the annulus, a connection element juxtaposed to an opening in the inner pipe and substantially aligned with a centerline of a portion of the inner pipe extending into the vessel, a sight glass assembly disposed in alignment with the connection element and allowing direct visual access to the interior of the molten metal bath, and an optical sensor connected to the sight glass assembly whereby light emanating from the interior of the molten metal bath can be analyzed to determine properties of the metal bath.

2. Apparatus according to claim 1, wherein the optical sensor is selected from the group consisting of a photometer, a spectrometer, a camera and combinations thereof.

3. Apparatus according to claim 2, wherein the inner pipe is connected to a source of transparent fluid selected from the group consisting of nitrogen, oxygen, carbon dioxide and argon, and the outer pipe is connected to a source of a cooling fluid selected from the group consisting of nitrogen, carbon dioxide, argon and methane.

4. Molten metal treatment apparatus comprising a treatment vessel having sidewalls, a bottom and an open mouth top, a concentric pipe tuyere suspended above the mouth of the vessel and vertically movable so that a lower, insulated portion of the tuyere may extend below the surface of a molten metal bath contained in the vessel, a sight glass assembly connected to an inner pipe of the tuyere and providing visual access to the interior of the inner pipe and to the interior of the molten metal bath, and an optical sensor connected to the sight glass assembly for analyzing light generated by the molten metal and determining physical properties thereof.

5. Apparatus according to claim 4, wherein the optical sensor is selected from the group consisting of a photometer, a spectrometer, a camera and combinations thereof.

6. Apparatus according to claim 5, further comprising a connection element at a top end of the tuyere, and a fiber optic light guide connected at one end to the sight glass assembly and, at another, remotely disposed, end, to the optical sensor.

7. Apparatus according to claim 6, further comprising means to pressurize and pass a transparent fluid through the inner pipe of the tuyere and to pressurize and pass a cooling fluid through an annulus formed between the inner pipe and an outer pipe of the tuyere.

8. Apparatus according to claim 7, wherein the inner pipe is connected to a source of transparent fluid selected from the group consisting of nitrogen, oxygen, carbon dioxide and argon, and the cooling fluid is selected from the group consisting of nitrogen, carbon dioxide, argon and methane.

9. Apparatus according to claim 8, further comprising a cooling fluid supply pipe, a transparent fluid supply pipe, a housing in which the sight glass lens assembly is mounted, enclosing an upper end of the tuyere, and having passages connected, respectively, to the cooling fluid supply pipe and to the transparent fluid supply pipe for introducing cooling fluid into an annulus between the inner and outer pipes of the tuyere and transparent fluid into the interior of the inner pipe of the tuyere.

10. A method of directly visually observing and analyzing the interior of a molten metal bath during treatment in a metallurgical treatment vessel, comprising extending a concentric pipe tuyere into the vessel and positioning a lower, insulated portion of the tuyere at a location below the surface of the molten metal bath; providing an opening in an inner pipe of the tuyere, said opening being aligned with a centerline of the tuyere and providing direct visual access to the interior of the molten metal bath, connecting to the opening in the inner pipe a sight glass and an optical sensor so that light generated by the molten metal in said bath can pass through the opening in the inner pipe to the sight glass and the optical sensor, and, with use of the optical sensor, analyzing the light to determine properties of the molten metal in said bath.

11. A method according to claim 10, further comprising pressurizing a transparent fluid and passing the pressurized transparent fluid through the inner pipe of the tuyere, and pressurizing a cooling fluid and passing the pressurized cooling fluid through an annulus formed between the inner pipe and an outer pipe of the tuyere.

12. A method according to claim 11, wherein the transparent fluid is selected from the group consisting of nitrogen, oxygen, carbon dioxide and argon, and the cooling fluid is selected from the group consisting of nitrogen, carbon dioxide, argon and methane.

13. A method according to claim 12, wherein the treatment of the molten metal is decarbonization of steel, and selecting oxygen as at least a component of the transparent fluid in order to generate heat by combustion with carbon thereby keeping the tip of the tuyere free of frozen metal and slag.

14. A method according to claim 13, comprising selecting the optical sensor from the group consisting of a photometer, a spectrometer, a camera, and combinations thereof.

15. A method according to any one of claim 10–14, comprising suspending the tuyere above an open mouth of the vessel and lowering the tuyere substantially vertically through the mouth of the vessel and below the surface of and directly into the molten metal.

* * * * *